US007163308B2

(12) United States Patent
Ferrari et al.

(10) Patent No.: US 7,163,308 B2
(45) Date of Patent: Jan. 16, 2007

(54) HAND WORN ILLUMINATED FRAMEWORK

(76) Inventors: John S. Ferrari, 6642 W. Ida Dr. #224, Littleton, CO (US) 80123; Dale C. Sommers, 9861 Palmer La., Northglenn, CO (US) 80260

( * ) Notice: Subject to any disclaimer, the term of this patent is extended or adjusted under 35 U.S.C. 154(b) by 54 days.

(21) Appl. No.: 10/993,871

(22) Filed: Nov. 22, 2004

(65) Prior Publication Data

US 2006/0109645 A1 May 25, 2006

(51) Int. Cl.
*F21V 21/08* (2006.01)

(52) U.S. Cl. ..... 362/103; 362/234; 362/800; 2/159; 2/160

(58) Field of Classification Search ..... 362/184, 362/234, 103, 800; 2/159, 160
See application file for complete search history.

(56) References Cited

U.S. PATENT DOCUMENTS 3,638,011 A 1/1972 Bain et al.
5,177,467 A 1/1993 Chung-Piao
D369,309 S 4/1996 Marbach
5,535,105 A 7/1996 Koenen Myers
5,580,154 A 12/1996 Coulter et al.
6,006,357 A 12/1999 Mead
6,592,235 B1 7/2003 Mayo

OTHER PUBLICATIONS

Disclosure Document by Applicant #539271—Sep. 28, 2003.

*Primary Examiner*—Stephen F Husar
*Assistant Examiner*—Meghan K. Dunwiddie

(57) ABSTRACT

For hand signal enhancement, a reversible, flexible illuminated framework, for wearing upon the human hand or over gloves.

Emanating from a wrist cuff, the framework comprises four or more rope light type LED illumination elements, that provide constant on, flashing, or sequential illumination, a battery pack upon the wrist cuff, an index finger mounted switch unit; the rope light is capable of various color illumination through use of waterproofed colored or clear translucent sheaths, the light elements are connected together with a web strap midway along the length of the light elements; fabric fingertip caps terminate the light elements and hold the light elements inline with the fingers of the hand; a Velcro band upon the light elements at the first finger joint of the index and the ring fingers keeps the lighting elements from rotating upon the fingers during use.

11 Claims, 4 Drawing Sheets

HAND WORN ILLUMINATED FRAMEWORK

FIELD OF THE INVENTION

This invention relates to gloves using illuminative technology such as light accessories, generally including signaling devices, and more particularly to illuminated signaling gloves and the like.

The present invention is a reversible flexible framework for wearing by itself upon the hand, and is an improved light emitting apparatus preferably for use in connection with the presentation of motor vehicle operator hand signals in poorly lit, dark or low visibility conditions. This light emitting framework has particular utility in connection with providing enhanced motor vehicle operator hand signals for use by motorcyclists, bicyclists and so forth.

Hand worn light emitting devices are also useful for providing a source of light under poorly lit or dark conditions and to visibly communicate ocean diving directional signals in scuba diving applications. A useful benefit in this field of the present invention is that the diver wearing the illuminated framework can be seen more clearly from a distance during periods of low visibility, enhancing safety.

The use of hand-held, color-hooded flashlights is presently the common method for ground crews to direct parking aircraft, especially at night. With the present invention utilized by the ground crews in conjunction with those flashlights, an enhanced signaling method shall be obtained.

BACKGROUND OF THE INVENTION

In the past, traffic-control and signaling personnel generally relied upon their own body movements in conjunction with the use of hand-held flashlights or hand-held signs to signal others and direct traffic. For example, the person's hand and arm movements in conjunction with the flashlights or signs could be used to direct oncoming vehicles, pedestrians, bicyclists, etc. to stop, turn a specified direction or to proceed in their present direction.

Using hand coverings such as gloves with illuminator accessories is well known in the prior art. An example, U.S. Pat. No. 3,638,011 to Bain et al. discloses a hand glove and light signal attachment controlled by a wrist-mounted switch. The Bain patent does not allow the user to operate the switch single-handedly with the hand while wearing the glove, and provides a singular light signal attachment.

The alarm and entertaining glove depicted in U.S. Pat. No. 5,177,467 to Chung-Piao provides a plurality of illuminators, each singularly mounted upon the finger portions of a glove. Additionally, an audio alarm function is present. A switch closes the circuit to activate the functions only if the thumb and forefinger are continuously held together. An additional glove identifies U.S. Pat. No. 5,535,105 to Koenen Myers et al. that provides for a work glove with a centralized light source, which is fed through fiber optics to the finger end. The Myers et al. patent does not include provision for a multiple lamp array, nor an onboard power supply.

Continuing, the apparatus shown in U.S. Pat. No. 5,580,154 to Coulter et al. illustrates a phosphorescent glove with the ability to have a child represent a fictional cartoon character. The apparatus has an illuminator contained within a ring upon the glove finger, and a switch activator provided upon the palm of the glove. The apparatus disclosed within Coulter et al draws primarily upon the phosphorescent ability of the glove coating for illumination.

A prior attempt to improve on this situation provides a glove that includes an equilateral triangle formed from a reflective material on the palm and back of the glove The gloves have been used for traffic-direction purposes because the upwardly oriented triangles can be used for signaling when the user points the hand to the side, in which case the tip of the triangle points in the direction of the user's fingers and indicates to others that they should proceed in the indicated direction. Similarly, when the user's hand is pointed so the palm faces others, the red, upwardly oriented triangle indicates that they should stop.

That art is depicted in U.S. Pat. No. 6,006,357 to Mead, which provides for a signaling glove with light reflective portions in geometric designs mounted upon the backhand portion of the glove, finger portions, and the palm portion. A separate light emitter is adaptable to illuminate the central triangular geometric design and the palm reflective portion. The triangular geometric design is oriented to have one point directed toward the finger portion of the glove. The glove of Mead relies substantially upon the reflective patches applied to the glove body.

Another glove apparatus illustrated by U.S. Pat. No. 6,592,235 to Mayo attaches singular light emitting units upon each fingertip of a glove. A thumb mounted switch and on board battery are present. No provision is allowed for sequential illumination of the light emitting units in a directional fashion.

Additionally, shown in U.S. Pat. No. D369, 309 to Marbach is the reflective traffic safety glove which has no illuminative accessory, and simply reflects light presented upon its surface.

While the above-described devices fulfill their respective objectives and requirements, the aforementioned patents do not describe a hand wearable, reversible rope light type light emitting flexible framework that provides single-handed activation for the illumination function, and these prior devices make no provision for turning the light source on and off single handedly with the hand wearing the framework attachment.

These modified glove structures have taught useful accessories, in particular glove structures with light accessories, however, the modified glove structures have not found commercial success A missing ingredient in those modified glove structures is a presentation that generates appeal and understandability while providing durability and functionality in the desired use.

Therefore, it is anticipated that a need exists for a new and improved hand wearable multiple element light emitting apparatus that can provide single-handed activation and illumination, while enhancing the presentation of motor vehicle hand signals.

Previously disclosed under the Disclosure Document Program, Sep. 28, 2003 identified as No. 539,271 in the U.S. Patent Office, the present invention substantially fulfills this need. The present invention further departs from the conventional concepts and designs of the prior art by the provision of a reversible, hand worn flexible framework, and a multi element lighting component which presents a sequential lamp display ability across the combined hand and finger length, and in doing so provides a superior illumination apparatus primarily developed for providing an enhanced motor vehicle operator safety accessory.

SUMMARY OF THE INVENTION

In summary, motorcycle riders and traffic control personnel need to be more visible at night when hand signals are used to notify and control vehicular traffic. When the present invention is actively worn by riders of motorcycles, scooters, or bicycles, the optical display alerts the traffic in the vicinity of the bike, especially at night, when the rider of the bike may not be otherwise visible. Accordingly, the present invention provides for a light weight signaling device adapted for use by bikers to reliably enhance hand signal effects in both daylight and at night.

The primary object of the present invention is to provide a hand worn flexible framework including a plurality of rope light style illuminators primarily serving as the flexible framework itself, which are electrically connected to a driving circuit secured on a wrist cuff, and a switch on the surface of the index finger, electrically connected to the driving circuit, and a detachable battery array secured upon the wrist cuff, whereby upon touching of the wearer's index finger with the thumb, the switch will be actuated to activate the illuminators for the optical presentation of enhanced motor vehicle hand signals.

Another object of the present invention is to provide a modified hand worn illuminator having differential colored translucent sheaths, which contain and waterproof the light emitting elements, and easily provide for application of differing coloration for the light emitting elements. It is therefore an object of the present invention to provide a new and improved hand worn multi-color light emitting apparatus that has advantages over the prior art illuminators.

Yet another object of the present invention is to provide a hand worn light-emitting apparatus that permits the user to turn the light source on and off with the hand wearing the apparatus, thereby enhancing utility. A further object of the present invention is to provide a light-emitting apparatus for providing illuminated hand signal presentation for use underwater. This makes it possible for a diver to signal directional intent which can be seen easily under low light conditions, thereby enhancing the wearer's safety.

Another object of the present invention is to provide a hand worn light-emitting framework for providing color choice illuminated hand signal presentation for use by air traffic ground control personnel. This makes it possible for a ground control member to signal directional intent to an approaching parking aircraft, which can be seen easily under low light conditions, and at further distances thereby enhancing air travel safety.

An object of the present invention is to provide a hand worn light-emitting framework for providing illuminated hand signal presentation for use during night skiing. This makes it possible for a skier to signal directional intent, which can be seen easily under low light conditions, thereby enhancing user and nearby skier safety.

In view of the foregoing disadvantages inherent in the known types of gloves with illuminator assemblies now present in the prior art, the present invention provides an improved hand worn light emitting framework, and overcomes the above-mentioned disadvantages and drawbacks of the prior art. As such, the general purpose of the present framework illuminator, has many novel features that result in a hand worn light emitting framework apparatus which is not anticipated, rendered obvious, suggested, or even implied by the prior art, either alone or in any combination thereof.

Numerous objects, features and advantages of the present invention will be readily apparent to those of ordinary skill in the art upon a reading of the following detailed description of current embodiments of the present invention when taken in conjunction with the accompanying drawings. This invention is capable of other embodiments and of being practiced and carried out in various ways. Also, the phraseology and terminology employed herein are for the purpose of descriptions and should not be regarded as limiting.

These together with other objects of the invention, along with the various features of novelty that characterize the invention, are pointed out with particularity in the claims annexed to and forming a part of this disclosure

DETAILED DESCRIPTION OF THE PREFERRED EMBODIMENT

The present invention is herein embodied as a vehicle operator safety improvement, which allows primarily for motorcyclists or bicyclists to be seen more readily at night and to better inform nearby motorists with hand signals day or night.

Figure 1:
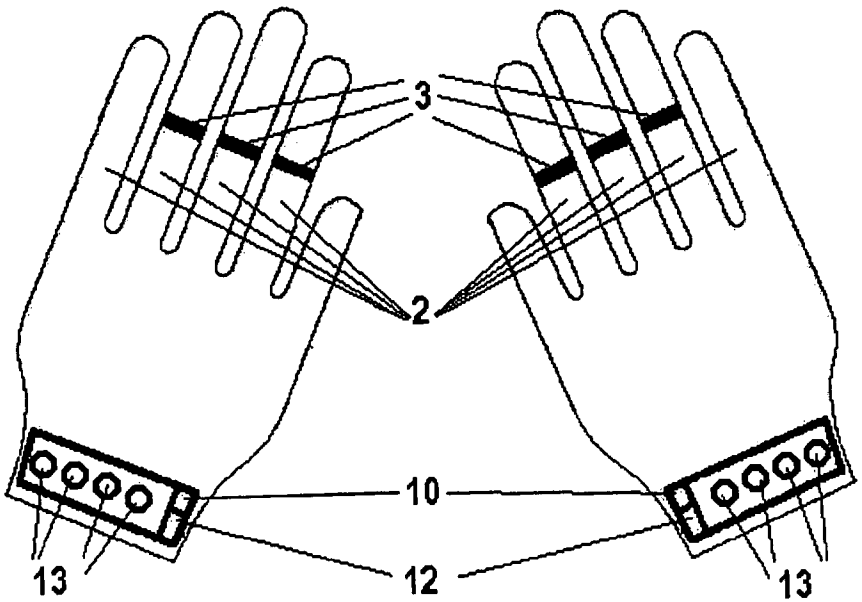
FIG. 1 is a top view showing the wearer's hand, having finger bands and wrist cuff attached, batteries included.
Figure 2:
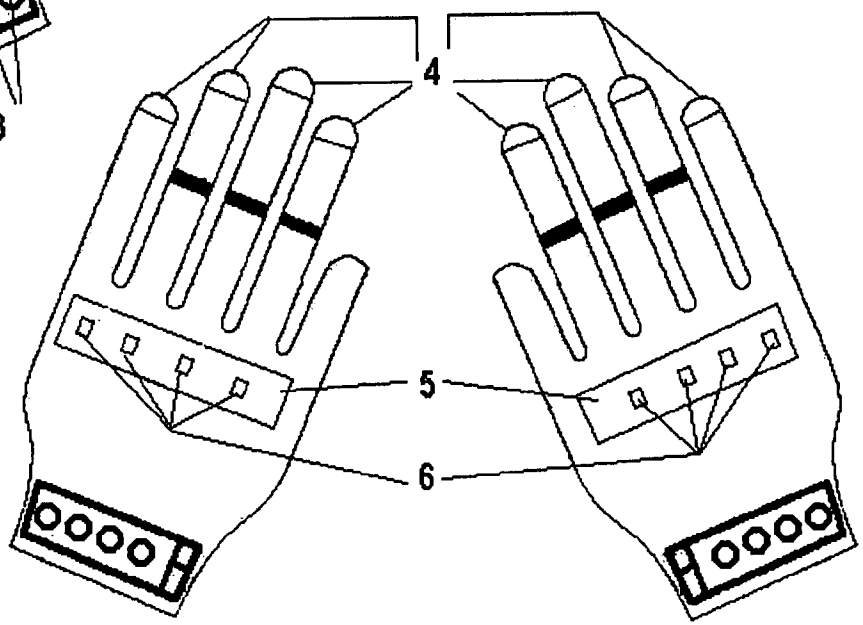
FIG. 2 is a top view of the wearer's hand, showing placement of the web strap and clip channels, introducing the fingertip caps.
Figure 3:
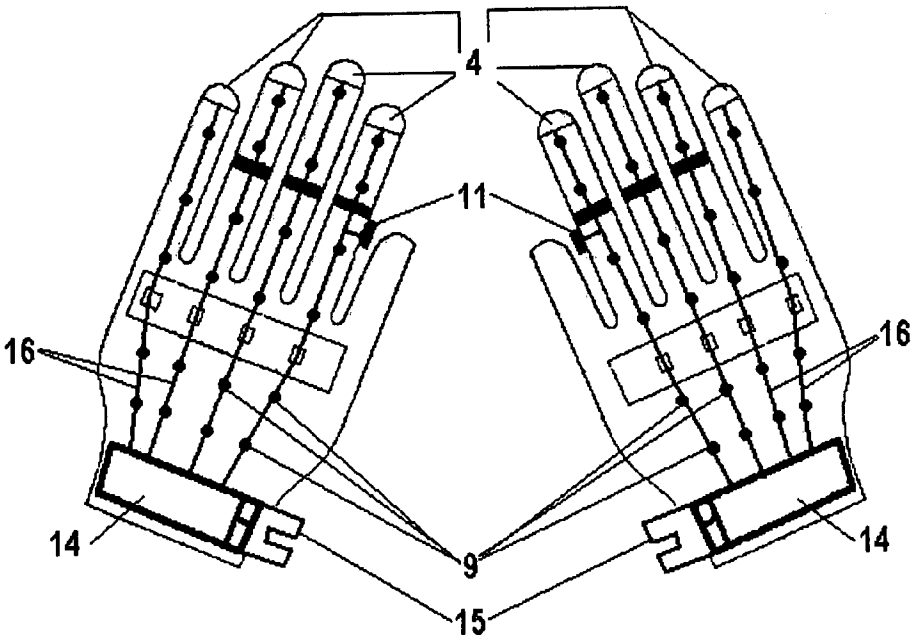
FIG. 3 is a top view of the wearer's hand, showing the flexible wiring, LED bulbs, the switch, the battery carrier, and the wrist cuff.
Figure 4:
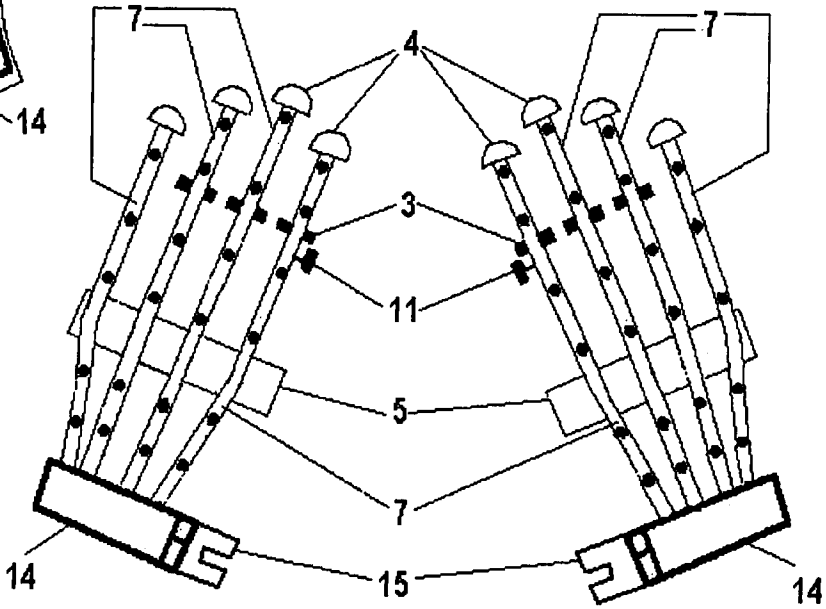
FIG. 4 is a top view of the flexible framework, depicting all the components.
Figure 5:
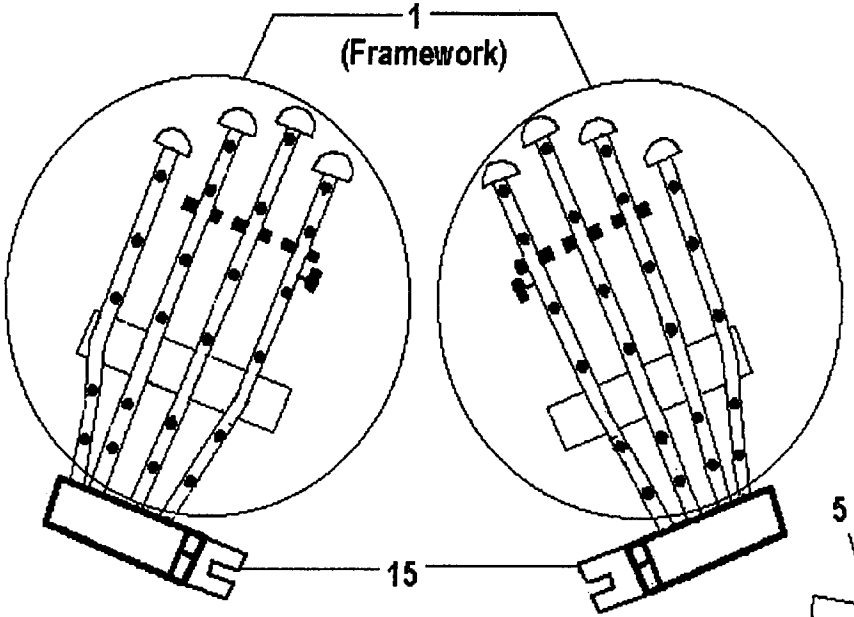
FIG. 5 is a top view of the flexible framework
Figure 6:
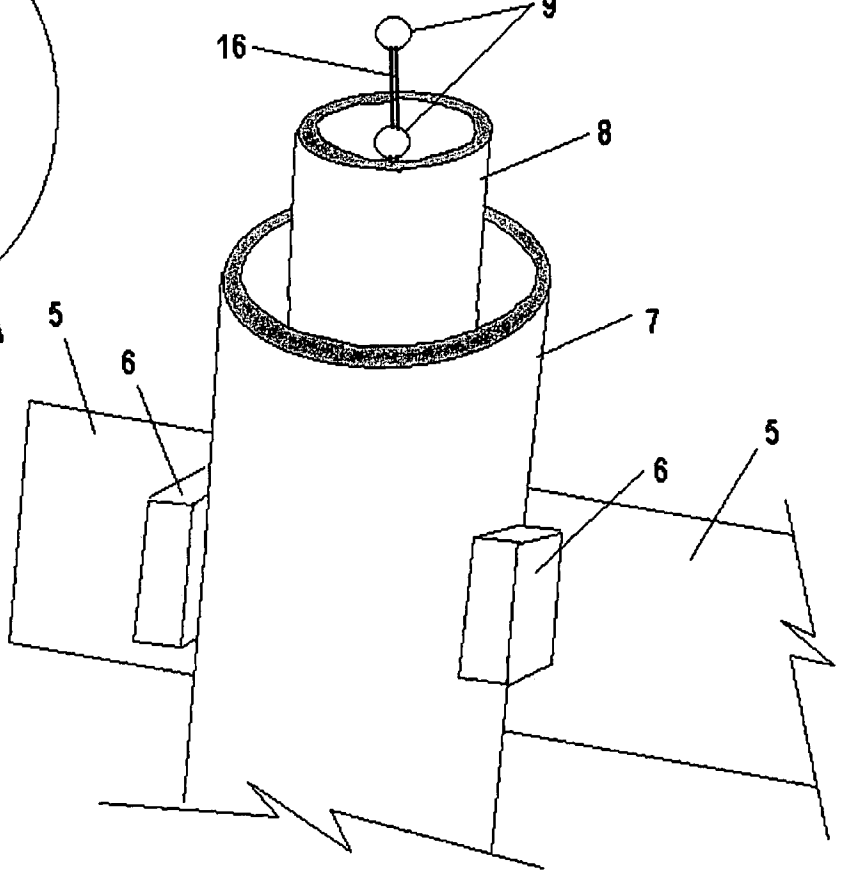
FIG. 6 is a cross section of the tubular sheath, showing the rope light, and LED bulbs.
Figure 7:
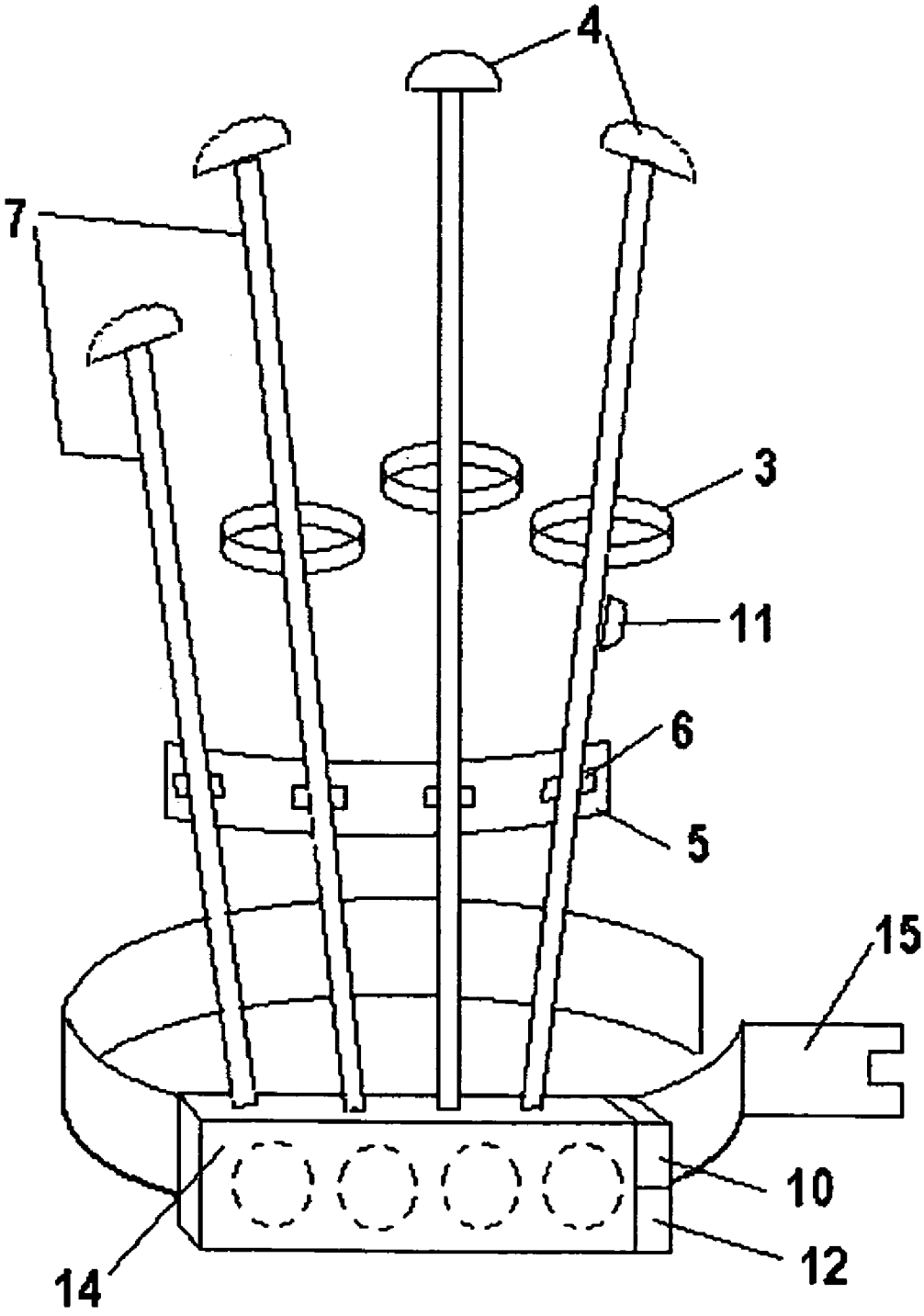
FIG. 7 is an isometric view of the entire framework, showing all components

A hand worn flexible framework signaling apparatus constructed according to the preferred embodiment of the present invention is shown in Drawings FIGS. 1–4. Framework 1, is normally worn on a user's hand like a conventional glove, or over a glove. The framework 1 extends the length of the backside or palm of the user's hand when the framework 1 is normally worn, and extends the full length of the wearer's fingers 2, atop and inline with each of the four main fingers 2 of the wearer's hand. The framework 1 elements emanate from the wearer's wrist, at the cuff 15. The framework 1 is terminated with flexible fabric fingertip portions 4 that snugly engage and cover the wearer's index, middle, ring, and pinkie fingertips.

The present safety improvement consists of the flexible illuminated tubular framework 1 elements including the four finger portions and a the fingertip caps 4. The framework 1 has a semi rigid releasable web strap 5 which spaces apart, supports, locates and serves to connect all four framework fingers of the framework 1. Four separate clip channels 6 hold the sheath 7 portions atop the web strap 5. A Velcro type finger band 3 is located at the first finger joint of the wearer's index, middle, and ring fingers. The finger bands 3 serve to prevent sheath 7 and switch 11 rotation upon the wearer's fingers 2.

The flexible framework portion of the present invention is essentially comprised of the combination of a flexible waterproofed translucent tubular sheath 7, and the multi-bulb LED 9 lighting rope 8, contained within the sheath 7.

The LED 9 optical display activation is controlled through a microchip controller 10 as necessary. A multi-function miniature switch 11 paired with the microchip 10 provide either on/off or sequential illumination operational modes as is known in the art. The preferred color of the LED bulb 9 array is white, with the flexible translucent sheath 7 bearing a red color throughout, although other flexible sheath colors may be used, including clear, yellow, green, orange, and the like, and segments of differing colors may be employed as necessary. ((Alternatively, a singular LED contained within the battery enclosure could serve to illuminate a light guide such as the common fiber optic cable, of varying diameters.)) The rope light 8 is presented on the wearer's four fingers 2 and extends the entire length of each finger 2, and further extends substantially the entire length of the backhand portion of the framework upon the wearer's hand, inline with the wearer's finger 2. All four of the rope lights 8 terminate at the wrist cuff 5 of the framework 1, where they interface with the control bus 12. Preferably, the lighting elements are powered by four digital watch batteries 13 that reside in tandem, within a flexible pack type carrier 14. The carrier 14 is velcro applied to the wrist cuff 15 of the framework 1, providing a reliable, easily accessed energy source which is selectively removable, to provide power for the rope lights 8. It provides the wrist cuff 15 attachment point for the sheath 7 elements and rope lights 8 which comprise the framework 1.

The switch 11 is in the form of a pushbutton type on/sequential/off switch 11 attached to the wearer's index finger 2 part of the framework 1. The switch 11 is electrically connected with the battery carrier 14, batteries 13, and rope lights 8 via flexible wires 16.

The miniature switch 11 is ideally located within easy user thumb reach, and is located below the second finger joint upon the index finger of the framework 1, for easy access. A single push on the switch 11 turns the rope lighting 8 array continuously on, and a second push turns the rope lighting 8 array to flashing mode. A third push on the switch 11 turns on sequential mode, and the fourth push deactivates the unit, an operation that is accomplished quickly and easily by the wearer. The preferred sequence of sequential mode illumination begins with simultaneous illumination of all singular LED 9 bulbs nearest the wrist cuff 15, then proceeds to simultaneously light the next inline individual LED 9 bulb, then the next, along the length of the wearer's backhand and along the wearer's finger 2 until finger 2 tip termination, at which time this sequence repeats, or until the rope light 8 array display function is cancelled at the switch 11. The switch 11 may be modified by those skilled in the art, so as to provide functions not yet herein described.

Although the primary use for such a hand worn illuminated signal framework 1 is for hand signal purposes for use on motorcycles and bicycles, it is foreseen that the framework 1 could have utility in areas such as: aircraft signal corps; police and traffic direction; emergency signal use for roadside motorist use; marine or pleasure boating signal use; ocean or scuba diving hand signal use; map reading or other flashlight type use (when in continuous light mode); night skiing and other recreational, military and civilian uses, including those uses which may require the simultaneous use of two or more framework 1 units on either hand, facial side or backhand.

In some applications, it may be desirable for to have a configuration that is directed for a specific purpose or to indicate a special signal to others, such as to stop, slow, perform a specific act, etc. This signaling capacity may be increased by the varying sheath 7 transparency or translucency, and including patterns or symbols screened onto the sheath 7 elements. The rope lighting 8 array, flexible translucent tubular sheaths 7, the microchip controller 10, the switch 11 element, and the battery carrier 14 are all replaceable for economical use, and user preference. For example, if the framework 1 is damaged, the individual translucent sheath 7 elements of the framework 1 can be replaced, and the sheath 7 color can be changed, segmented or customized to suit a specific display requirement. Further, the fingertip cap 4 closure, the web strap 5, and the finger bands 3, are replaceable.

While a current embodiment of the hand worn light-emitting framework has been shown and described here in detail, it is recognized that departures can be made, to include variations in hand size, framework materials, shape, form, function and manner of operation, assembly and use, using fiber optic technology for illumination, all reside within the scope of the invention, and that some modifications and variations thereto are possible, all of which fall within the true spirit and scope of the invention.

We claim:

1. The light emitting flexible framework worn upon the hand or over a glove, comprising:

A hand sized reversible flexible body for wearing upon the human hand, having an exterior surface, a wrist cuff, and four fingers, four said fingers extend from the fingertips towards termination at the wrist cuff of the flexible body, and said exterior surface is selected from the group consisting of rubber, neoprene, plastics or vinyl; and a series of removable replaceable clear translucent waterproofed tubular sheaths forming said flexible body exterior surface, comprising the four finger portions of said flexible body, the four finger portions extend the full length of the index, middle, ring, and pinkie fingers of the human hand, said finger portions extend fully onto the backhand portion of said human hand, terminating at the wrist cuff of said flexible body at a battery enclosure; and a selectively releasable hook and loop type fastening band for securing said sheaths onto the human index, middle, ring, and pinkie fingers; and a flexible fabric fingertip receptacle cap attached to the fingertip termination end of each said translucent sheath; and a watertight closure at the fingertip termination and wrist termination ends of each said translucent sheath; and a supportive, semi rigid web strap having surface mounted separator channel clips to locate and hold said individual sheaths spaced one apart from another, said web strap is selectively positioned upon the central backhand portion of said flexible body, above said wrist cuff, and below said fastening bands; and a set of releasable inline rope light illumination elements, residing within said sheaths on the flexible body; said illumination elements extend the full length of each individual sheath, said illumination elements comprise an inline array of light emitting diodes integrally assembled as a unit; and a detachable battery enclosure for containing multiple miniature batteries, and a microprocessor circuit, mounted to the wrist cuff of said flexible body, said battery enclosure is electrically connected with said rope light illuminators via flexible wiring; and a pressure-sensitive waterproof multi function micro switch attached to the thumb-side surface of the forefinger of said flexible body, to operate said illumination elements, said switch communicates with said detachable battery case via flexible wiring.

2. The flexible body as described in claim 1, wherein said tubular translucent sheaths are colored.

3. The flexible body as described in claim 2, wherein said battery enclosure is enlarged in capacity and has output ports for the insertion of supplementary illumination elements.

4. The flexible body as described in claim 2, wherein the fingertip caps are sewn one to another together, forming a mitten shape.

5. The flexible body as described in claim 2, wherein the flexible body has an enhanced waterproofed exterior surface and battery closures, suitable for use in submarine environments.

6. The flexible body described in claim 2, wherein the rope light elements are specifically programmed in display capability to aid aircraft ground operations personnel in providing gate approach or departure signals.

7. The flexible body described in claim 2, which is detachably mounted to a hand worn glove.

8. The flexible body described in claim 2, wherein fiber optic structural components serve as said illumination elements.

9. The flexible body described in claim 2, wherein said battery enclosure is modified to contain 4 or more LED type light elements within the enclosure.

10. The flexible body described in claim 2, wherein said battery enclosure is modified to accept a removable transparent colored window at the wrist termination end of said lighting elements.

11. The flexible body described in claim 2, wherein flexible electro luminescent components serve as said illumination elements.

* * * * *